US005271368A

United States Patent [19]

Fujii et al.

[11] Patent Number: 5,271,368

[45] Date of Patent: Dec. 21, 1993

[54] FUEL CONTROL SYSTEM FOR ENGINE

[75] Inventors: Masaki Fujii; Shigetoshi Kawano; Hideki Kobayashi, all of Hiroshima, Japan

[73] Assignee: Mazda Motor Corporation, Hiroshima, Japan

[21] Appl. No.: 43,846

[22] Filed: Apr. 7, 1993

[30] Foreign Application Priority Data

Apr. 9, 1992 [JP] Japan ..... 4-088824

[51] Int. Cl.[5] ..... F02D 41/12

[52] U.S. Cl. ..... 123/493

[58] Field of Search ..... 123/325, 493, 198 DB

[56] References Cited

U.S. PATENT DOCUMENTS

| | | | |
|---|---|---|---|
| 4,510,901 | 4/1985 | Yatabe et al. | 123/325 |
| 4,510,902 | 4/1985 | Tsuchida et al. | 123/325 |
| 4,581,924 | 4/1986 | Otobe et al. | 123/493 X |
| 4,694,796 | 9/1987 | Mori | 123/325 |
| 4,729,354 | 3/1988 | Tominaga et al. | 123/493 X |
| 4,730,587 | 3/1988 | Norota et al. | 123/493 X |
| 4,790,275 | 12/1988 | Iida | 123/325 |
| 4,860,211 | 8/1989 | Hatanaka et al. | 123/325 X |

FOREIGN PATENT DOCUMENTS 55-34295 9/1980 Japan .

*Primary Examiner*—Willis R. Wolfe

*Attorney, Agent, or Firm*—Sixbey, Friedman, Leedom & Ferguson

[57] ABSTRACT

In a fuel control system of an engine having an air conditioner driven by the engine, fuel supply is cut during deceleration of the engine when the engine speed is higher than a first preset value with the air conditioner on and when the engine speed is higher than a second preset value with the air conditioner off, the first preset value being higher than the second preset value. When the air conditioner is turned off during the deceleration of the engine, fuel supply is cut when the engine speed is higher than the first preset value, and when the air conditioner is turned on during the deceleration of the engine, fuel supply is cut when the engine speed is higher than the second preset value.

7 Claims, 4 Drawing Sheets

FUEL CONTROL SYSTEM FOR ENGINE

BACKGROUND OF THE INVENTION

1. Field of the Invention

This invention relates to a fuel control system for an engine, and more particularly to a fuel control system for an engine in which fuel supply to the engine is cut during deceleration at different engine speeds depending on whether or not an accessory mechanism such as an air conditioner is operating.

2. Description of the Prior Art

There has been known a fuel control system in which it is determined that the engine is decelerating and fuel supply to the engine is cut when the throttle valve is full closed and the engine speed is not lower than a preset speed in order to improve fuel economy and clean the engine emission. When an accessory mechanism such as an air conditioner is operating, the preset speed is set higher than when the accessory mechanism is not operating, thereby preventing hunting and engine stall.

However, in the conventional fuel control system, there has been a problem that when, for instance, the air conditioner is turned off while the engine is decelerating, that is, when the air conditioner changes from the operating state to the inoperative state while the engine is decelerating, toque shock occurs due to reduction in the engine load and shock occurs due to initiation of fuel cut, which causes uncomfortable vibration of the vehicle body.

SUMMARY OF THE INVENTION

In view of the foregoing observations and description, the primary object of the present invention is to provide a fuel control system for an engine in which torque shock which is caused when the state of an accessory mechanism changes simultaneously with initiation of fuel cut can be avoided.

In accordance with one aspect of the present invention, there is provided a fuel control system for an engine having an accessory mechanism driven by the engine comprising an accessory state detecting means which detects whether the accessory mechanism is operating, a deceleration detecting means which detects that the engine is decelerating, an engine speed detecting means which detects the engine speed, a fuel cut means which cuts fuel supply to the engine when the deceleration detecting means detects that the engine is decelerating and the engine speed detected by the engine speed detecting means is higher than a preset engine speed, a preset engine speed changing means which increases the value of the preset engine speed when the accessory state detecting means detects that the accessory mechanism is operating, and an inhibiting means which inhibits the preset engine speed changing means from changing the value of the preset engine speed when the state of the accessory mechanism changes while the engine is decelerating.

In accordance with another aspect of the present invention, there is provided a fuel control system for an engine having an accessory mechanism driven by the engine comprising an accessory state detecting means which detects whether the accessory mechanism is operating, a deceleration detecting means which detects that the engine is decelerating, an engine speed detecting means which detects the engine speed, a fuel cut means which cuts fuel supply to the engine when the deceleration detecting means detects that the engine is decelerating and the engine speed detected by the engine speed detecting means is higher than a preset engine speed, a preset value setting means which sets the preset engine speed to a first value when the accessory state detecting means detects that the accessory mechanism is operating and to a second value lower than the first value when the accessory state detecting means detects that the accessory mechanism is not operating, and an inhibiting means which inhibits the preset value setting means from changing the value of the preset value when the state of the accessory mechanism changes while the engine is decelerating and at the same time the engine speed detected by the engine speed detecting means is between the first and second values of the preset engine speed.

With these arrangements, torque shocks caused by turning off the accessory mechanism and caused by fuel cut cannot synchronize with each other to enhance the shock.

DESCRIPTION OF THE PREFERRED EMBODIMENT

Figure 1:
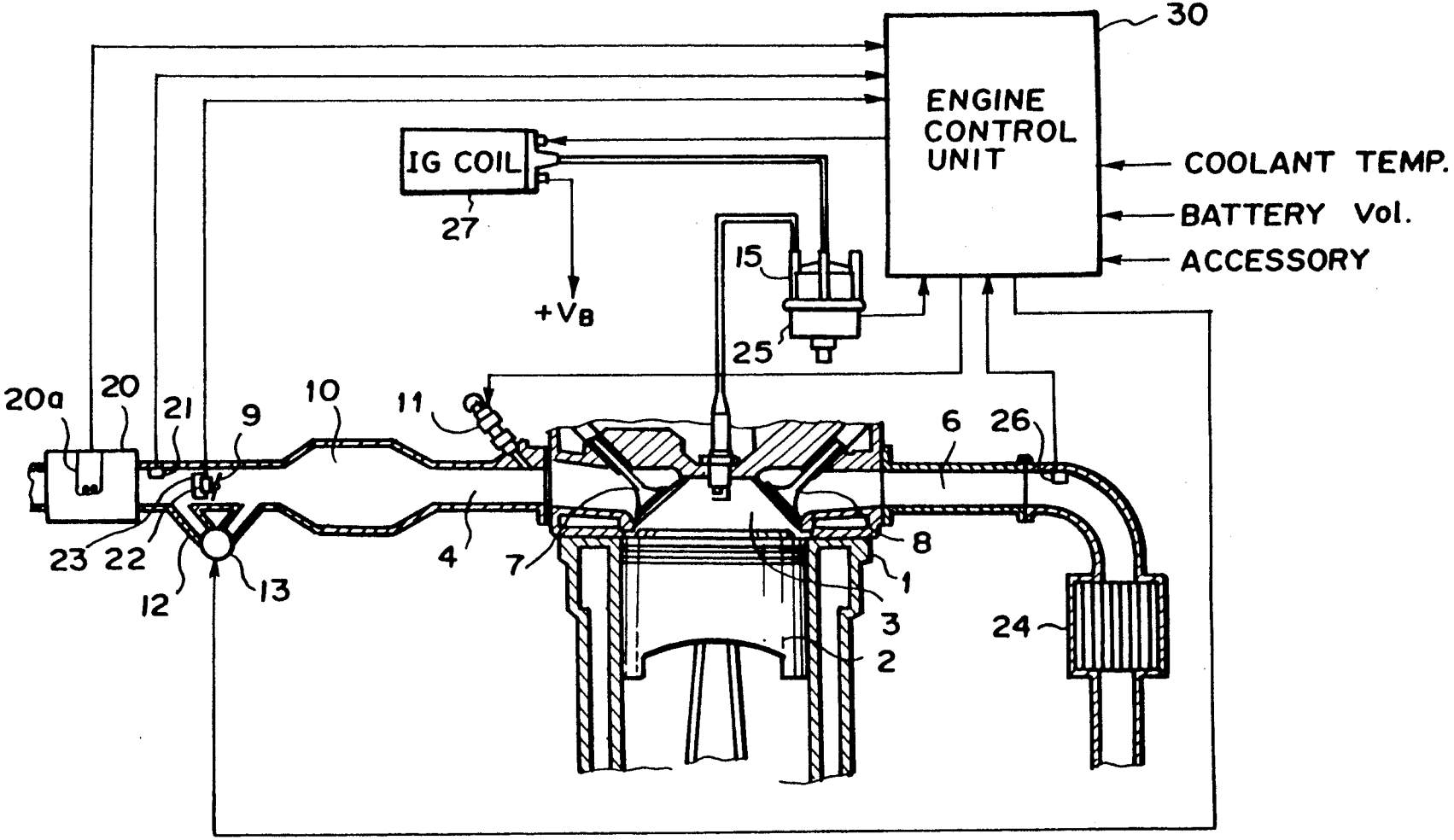
FIG. 1 is a schematic view showing a fuel control system in accordance with an embodiment of the present invention.

In FIG. 1, an engine 1 has a combustion chamber 3 and a piston 2 slidably received in the combustion chamber 3. Reference numeral 4 denotes an intake port provided with an intake valve 7 and reference numeral 6 denotes an exhaust port provided with an exhaust valve 8.

The intake port 4 is connected to an intake passage provided with a throttle valve 9 and a surge tank 10 downstream of the throttle valve 9. A fuel injector 11 is provided in the intake passage downstream of the surge tank 10. An airflow sensor 20*a* in an airflow meter 20 detects the amount of intake air introduced into the intake port 4. An intake air temperature sensor 21 detects the temperature of intake air. A throttle opening sensor 23 detects the opening of the throttle valve 9 and has an idle switch 22. An engine speed sensor 25 detects the engine speed by way of a distributor 15. An $O_2$ sensor 26 and a catalytic convertor 24 are provided in the exhaust port 6.

An engine control unit 30 receives signals from the sensors described above and ON/OFF signals from accessory mechanisms such as a compressor for an air conditioner, a pump for a power steering system and the like which are driven by the crankshaft of the engine by way of a belt, and controls the distributor 15 and the fuel injector 11. The engine control unit 30 further controls an on-off valve 13 provided in a bypass intake passage 12.

Figure 2:
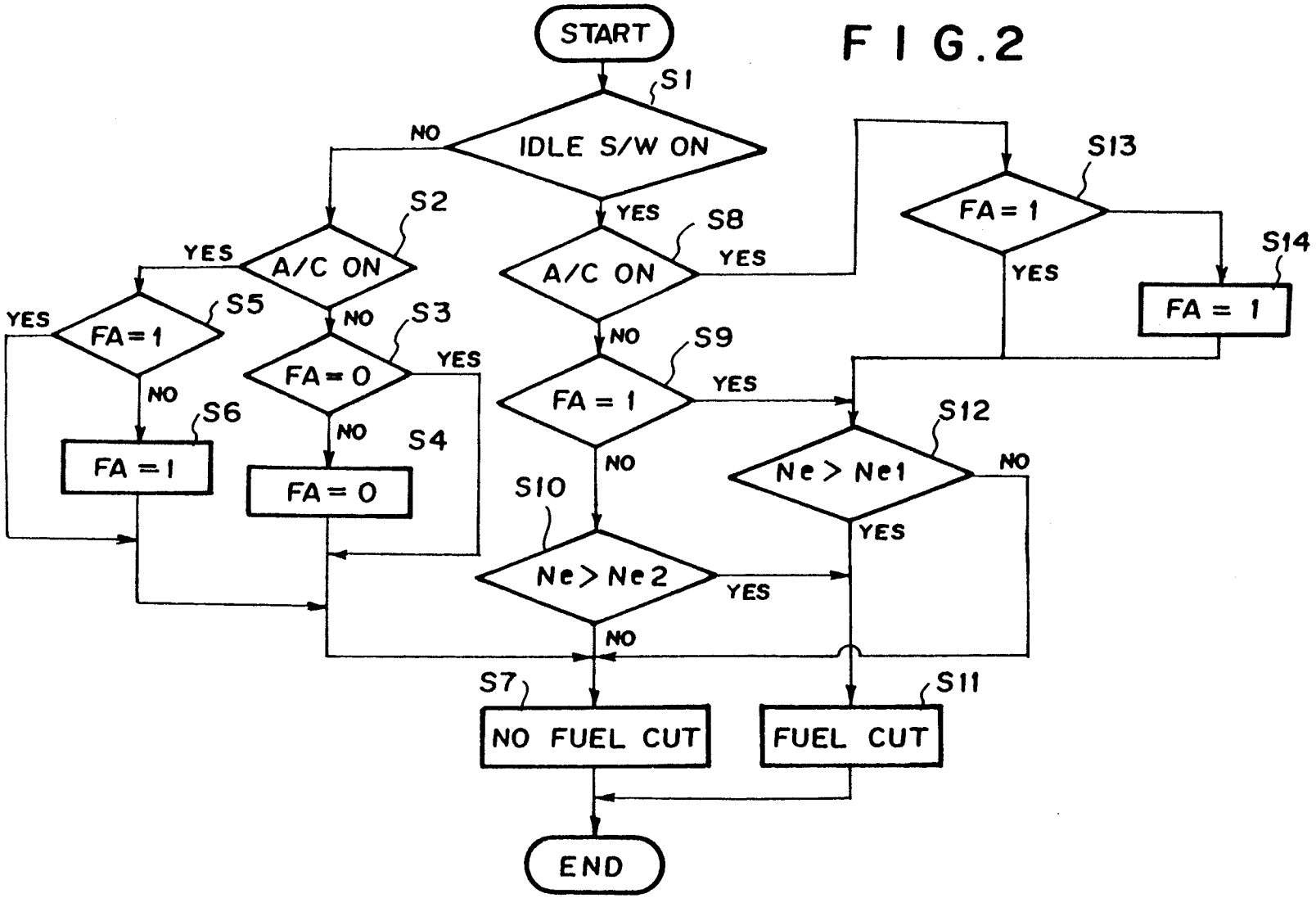
FIG. 2 is a flow chart for illustrating the operation of the engine control unit.

The operation of the engine control unit 30 will be described with reference to the flow chart shown in FIG. 2, hereinbelow.

The engine control unit 30 first determines whether the idle switch 22 is ON. The idle switch 22 is turned on when the throttle valve 9 is full closed, that is, when the engine is decelerating. (step S1) When it is determined than the idle switch 22 is not ON, the engine control unit 30 determines whether the compressor for the air conditioner is driven by the engine (hereinafter referred to ON) (step S2). When it is determined that the compressor for the air conditioner is not driven by the engine (hereinafter referred to not ON), the engine control unit 30 determines in step S3 whether air conditioner flag FA (which is set to 1 when the air conditioner is turned on) is 0, and when it is determined that the air conditioner flag FA is 0, the engine control unit 30 directly proceeds to step S7 and otherwise proceeds to step S7 after setting the air conditioner flag FA to 0 in step S4. In step S7, the engine control unit 30 does not perform fuel cut. When it is determined in step S2 that the air conditioner is ON, the engine control unit 30 determines in step S5 whether the air conditioner flag FA is 1, and when it is determined that the air conditioner flag FA is 1, the engine control unit 30 directly proceeds to step S7 and otherwise proceeds to step S7 after setting the air conditioner flag FA to 1 in step S6.

Figure 3:
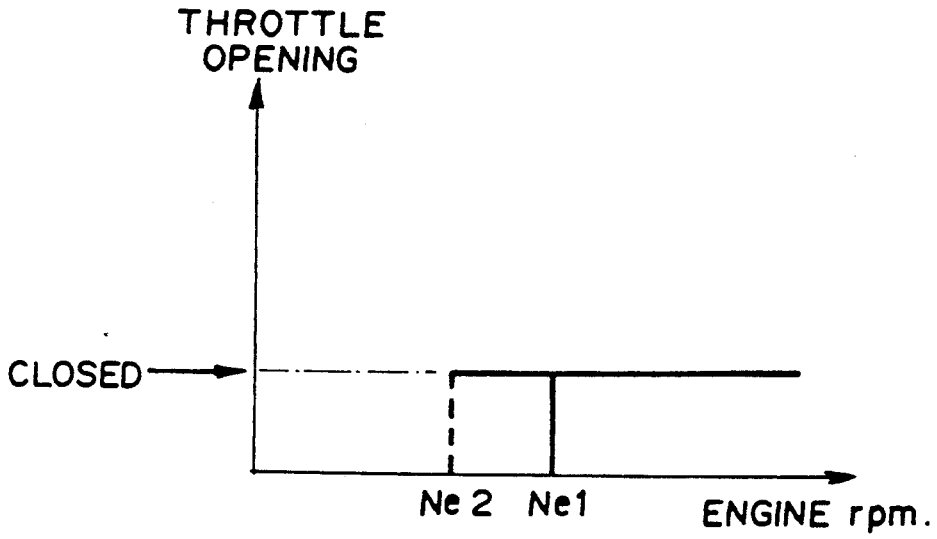
FIG. 3 is a view showing the relation between the present engine speed and the throttle opening.

When it is determined in step S1 that the idle switch 22 is ON, the engine control unit 30 determines in step S8 whether the air conditioner is ON. When it is determined that the air conditioner is not ON, the engine control unit 30 determines in step S9 whether the air conditioner flag FA is 1. When it is determined in step S9 that the air conditioner flag FA is not 1, which means that the air conditioner has been OFF from before the idle switch 22 was turned on, the engine control unit 30 determines whether fuel cut is to be performed on the basis of whether the engine speed Ne is higher than a second preset value Ne2 which is lower than a first preset value Ne1 as shown in FIG. 3. That is, the engine control unit 30 determines in step S10 whether the engine speed Ne is higher than the second preset value Ne2, and when it is determined that the former is higher than the latter, the engine control unit 30 proceeds to step S11 and performs fuel cut, and otherwise the engine control unit 30 proceeds to step S7.

On the other hand, when it is determined in step S9 that the air conditioner flag FA is 1, which means that the air conditioner has changed from the operating state to the inoperative state after the idle switch was turned on, the engine control unit 30 determines whether fuel cut is to be performed on the basis of whether the engine speed Ne is higher than the first preset value Ne1. That is, the engine control unit 30 determines in step S12 whether the engine speed Ne is higher than the first preset value Ne1, and when it is determined that the former is higher than the latter, the engine control unit 30 proceeds to step S11 and performs fuel cut, and otherwise the engine control unit 30 proceeds to step S7.

When it is determined in step S8 that the air conditioner is ON, the engine control unit 30 determines in step S13 whether the air conditioner flag FA is 1. When it is determined in step S13 that the air conditioner flag FA is 1, the engine control unit 30 directly proceeds to step S12 and otherwise the engine control unit 30 proceeds to step S12 after setting the air conditioner frag FA to 1 in step S14. In step S12, the engine control unit 30 determines whether the engine speed Ne is higher than the first preset value Ne1, and when it is determined that the former is higher than the latter, the engine control unit 30 proceeds to step S11 and performs fuel cut, and otherwise the engine control unit 30 proceeds to step S7.

As can be understood from the description above, in this embodiment, whether fuel cut is to be performed during deceleration of the engine is determined on the basis of whether the engine speed is higher than the first preset value Ne1 which is higher than the second preset value Ne2 when the air conditioner is on and on the basis of whether the engine speed is higher than the second preset value Ne2 when the air conditioner is off though the determination is made on the basis of the first preset value Ne1 when the air conditioner is turned off during the deceleration of the engine.

Figure 4:
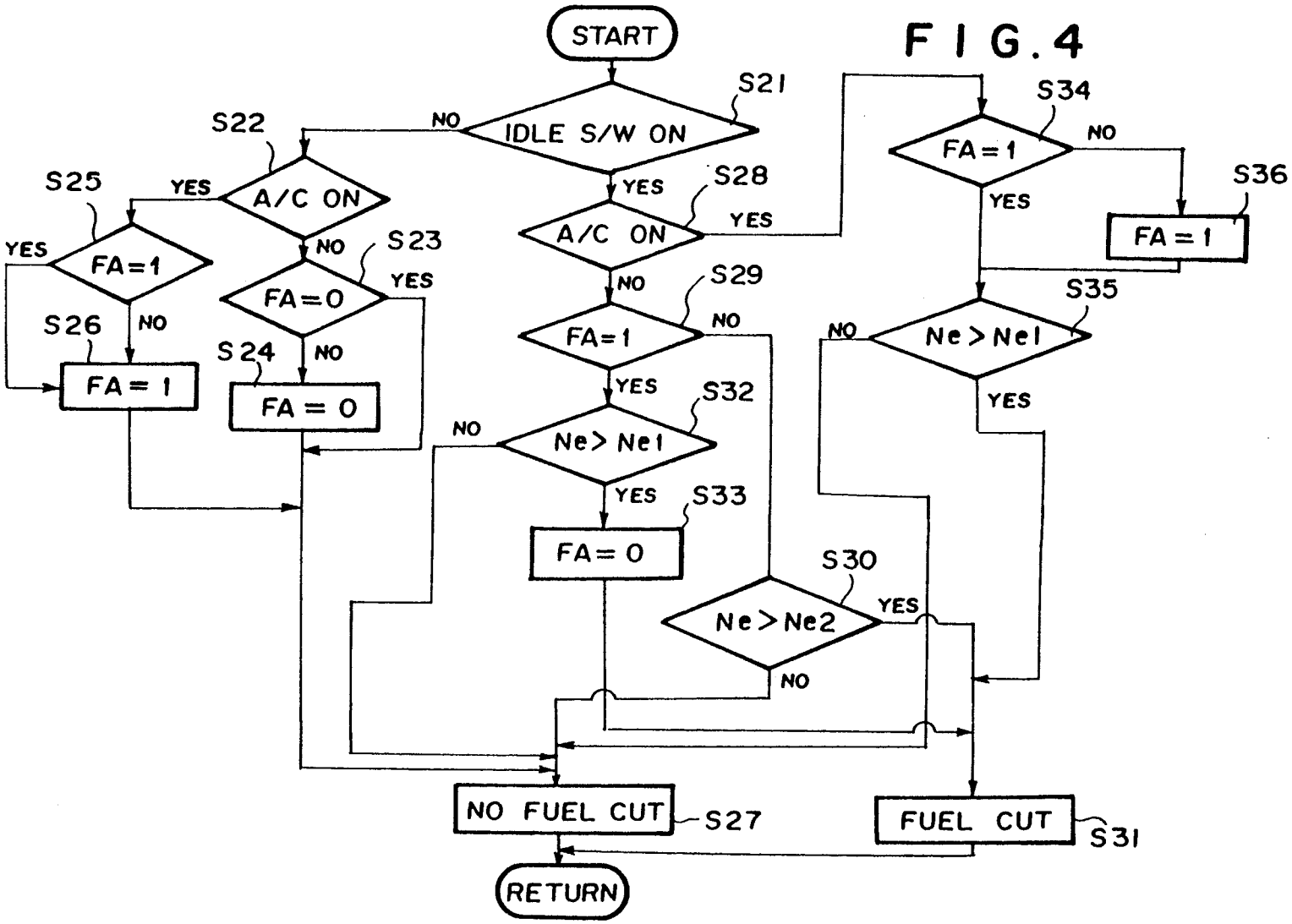
FIG. 4 is a flow chart for illustrating the operation of the engine control unit in another embodiment of the present invention.

The operation of the engine control unit 30 in another embodiment of the present invention will be described with reference to the flow chart shown in FIG. 4, hereinbelow.

The engine control unit 30 first determines whether the idle switch 22 is ON. (step S21) When it is determined than the idle switch 22 is not ON, the engine control unit 30 determines whether the air conditioner is ON. (step S22) When it is determined that the air conditioner is not ON, the engine control unit 30 determines in step S23 whether air conditioner flag FA is 0, and when it is determined that the air conditioner flag FA is 0, the engine control unit 30 directly proceeds to step S27 and otherwise proceeds to step S27 after setting the air conditioner flag FA to 0 in step S24. In step S27, the engine control unit 30 does not perform fuel cut.

When it is determined in step S22 that the air conditioner is ON, the engine control unit 30 determines in step S25 whether the air conditioner flag FA is 1, and when it is determined that the air conditioner flag FA is 1, the engine control unit 30 directly proceeds to step S27 and otherwise proceeds to step S27 after setting the air conditioner flag FA to 1 in step S26.

When it is determined in step S21 that the idle switch 22 is ON, the engine control unit 30 determines in step S28 whether the air conditioner is ON. When it is determined that the air conditioner is not ON, the engine control unit 30 determines in step S29 whether the air conditioner flag FA is 1. When it is determined in step S29 that the air conditioner flag FA is not 1, which means that the air conditioner has been OFF from before the idle switch 22 was turned on, the engine control unit 30 determines whether fuel cut is to be performed on the basis of whether the engine speed Ne is higher than a second preset value Ne2 which is lower than a first preset value Ne1. That is, the engine control unit 30 determines in step S30 whether the engine speed Ne is higher than the second preset value Ne2, and when it is determined that the former is higher than the latter, the engine control unit 30 proceeds to step S31 and performs fuel cut, and otherwise the engine control unit 30 proceeds to step S27.

On the other hand, when it is determined in step S29 that the air conditioner flag FA is 1, which means that the air conditioner has changed from the operating state to the inoperative state after the idle switch was turned on, the engine control unit 30 determines whether fuel cut is to be performed on the basis of whether the engine speed Ne is higher than the first preset value Ne1. That is, the engine control unit 30 determines in step S32 whether the engine speed Ne is higher than the first preset value Ne1, and when it is determined that the former is higher than the latter, the engine control unit 30 proceeds to step S31 after setting the air conditioner flag FA to 0 in step S33 and performs fuel cut, and otherwise the engine control unit 30 proceeds to step S27.

When it is determined in step S28 that the air conditioner is ON, the engine control unit 30 determines in step S34 whether the air conditioner flag FA is 1. When it is determined in step S34 that the air conditioner flag FA is 1, the engine control unit 30 directly proceeds to step S35 and otherwise the engine control unit 30 proceeds to step S35 after setting the air conditioner flag FA to 1 in step S36. In step S35, the engine control unit 30 determines whether the engine speed Ne is higher than the first preset value Ne1, and when it is determined that the former is higher than the latter, the engine control unit 30 proceeds to step S31 and performs fuel cut, and otherwise the engine control unit 30 proceeds to step S27.

As can be understood from the description above, in this embodiment, whether fuel cut is to be performed during deceleration of the engine is determined on the basis of whether the engine speed is higher than the first preset value Ne1 which is higher than the second preset value Ne2 when the air conditioner is on and on the basis of whether the engine speed is higher than the second preset value Ne2 when the air conditioner is off though the determination is made on the basis of the first preset value Ne1 when the air conditioner is turned off during the deceleration of the engine and the engine speed is between the first and second preset values.

What is claimed is;

1. A fuel control system for an engine having an accessory mechanism driven by the engine comprising
- an accessory state detecting means which detects whether the accessory mechanism is operating,
- a deceleration detecting means which detects that the engine is decelerating,
- an engine speed detecting means which detects the engine speed,
- a fuel cut means which cuts fuel supply to the engine when the deceleration detecting means detects that the engine is decelerating and the engine speed detected by the engine speed detecting means is higher than a preset engine speed,
- a preset engine speed changing means which increases the value of the preset engine speed when the accessory state detecting means detects that the accessory mechanism is operating, and
- an inhibiting means which inhibits the preset engine speed changing means from changing the value of the preset engine speed when the state of the accessory mechanism changes while the engine is decelerating.

2. A fuel control system as defined in claim 1 in which said deceleration detecting means determines that the engine is decelerating when the throttle valve of the engine is full closed.

3. A fuel control system as defined in claim 1 in which said accessory mechanism is an air conditioner.

4. A fuel control system for an engine having an accessory mechanism driven by the engine comprising
- an accessory state detecting means which detects whether the accessory mechanism is operating,
- a deceleration detecting means which detects that the engine is decelerating,
- an engine speed detecting means which detects the engine speed,
- a fuel cut means which cuts fuel supply to the engine when the deceleration detecting means detects that the engine is decelerating and the engine speed detected by the engine speed detecting means is higher than a preset engine speed,
- a preset value setting means which sets the preset engine speed to a first value when the accessory state detecting means detects that the accessory mechanism is operating and to a second value lower than the first value when the accessory state detecting means detects that the accessory mechanism is not operating, and
- an inhibiting means which inhibits the preset value setting means from changing the value of the preset value when the state of the accessory mechanism changes while the engine is decelerating and at the same time the engine speed detected by the engine speed detecting means is between the first and second values of the preset engine speed.

5. A fuel control system as defined in claim 4 in which said deceleration detecting means determines that the engine is decelerating when the throttle valve of the engine is full closed.

6. A fuel control system as defined in claim 4 in which said accessory mechanism is an air conditioner.

7. A fuel control system for an engine having an accessory mechanism driven by the engine comprising
- an accessory state detecting means which detects whether the accessory mechanism is operating,
- a deceleration detecting means which detects that the engine is decelerating,
- an engine speed detecting means which detects the engine speed,
- a fuel cut means which cuts fuel supply to the engine when the deceleration detecting means detects that the engine is decelerating and the engine speed detected by the engine speed detecting means is higher than a preset engine speed, and
- a preset value setting means which sets the preset engine speed to a first value when the accessory state detecting means detects that the accessory mechanism is operating and to a second value lower than the first value when the accessory state detecting means detects that the accessory mechanism is not operating while the engine is not decelerating.

* * * * *